United States Patent [19]

Sattler

[11] Patent Number: 4,784,816

[45] Date of Patent: Nov. 15, 1988

[54] METHOD FOR CONTINUOUS MANUFACTURE OF INORGANICALLY BONDED MATERIALS, ESPECIALLY MATERIAL SLABS

[75] Inventor: Heinz Sattler, Braunschweig, Fed. Rep. of Germany

[73] Assignee: Fraunhofer-Gesellschaft Zur Forderung Der Angewandten Forschung e.V, Munich, Fed. Rep. of Germany

[21] Appl. No.: 97,427

[22] Filed: Sep. 16, 1987

Related U.S. Application Data

[63] Continuation of Ser. No. 763,444, Aug. 7, 1985, abandoned.

[30] Foreign Application Priority Data

Aug. 13, 1984 [DE] Fed. Rep. of Germany ..... 3429790
Nov. 15, 1984 [DE] Fed. Rep. of Germany ..... 3441839

[51] Int. Cl.[4] ..... B28B 3/20

[52] U.S. Cl. ..... 264/210.2; 106/85; 106/110; 156/39; 264/211.11; 264/333

[58] Field of Search ..... 264/120, 109, 122, 333, 264/211.11, 210.1, 210.2; 425/371; 106/85, 109, 110, 115; 156/39

[56] References Cited

U.S. PATENT DOCUMENTS

| | | | |
|---|---|---|---|
| 2,356,826 | 8/1944 | Coss | 264/120 |
| 2,655,458 | 10/1953 | Collins | 264/109 |
| 3,832,115 | 8/1974 | Ettel | 264/109 |
| 4,017,245 | 4/1977 | Lang | 425/371 |
| 4,316,865 | 2/1982 | Battigelli et al. | 264/109 |
| 4,326,844 | 4/1982 | Kissel | 264/109 |
| 4,358,418 | 11/1982 | Heggenstaller | 264/120 |
| 4,410,474 | 10/1983 | Ahrweiler | 264/109 |
| 4,420,299 | 12/1983 | DeMets | 425/371 |
| 4,626,389 | 12/1986 | Lempfer et al. | 264/40.7 |

*Primary Examiner*—Jan H. Silbaugh
*Assistant Examiner*—Mary Lynn Fertig
*Attorney, Agent, or Firm*—Weingarten, Schurgin, Gagnebin & Hayes

[57] ABSTRACT

The invention relates to a method for continuous manufacture of materials, especially material slabs, from mixtures of binders, reinforcing agents, and possibly additives, the mixtures being cured by hydrate formation and being of a pourable or spreadable consistency. The special properties and usability of the materials are achieved by a permanent and irreversible compression of the initially-formed structure, whereby an extruded slab is formed from the mixture, then compressed and calibrated. The extruded slab is first compressed in a compression phase at a pressure which is sufficiently high that the slab's thickness after compression is less than the specified value of the finished extruded slab, and its density specified final density, the resulting values of density and degree of compression being sufficiently high that the compressed extruded slab is calibratable immediately thereafter in a calibration phase without the active application of pressure. In addition, the invention provides a device for working this method.

10 Claims, 3 Drawing Sheets

Figure 1:
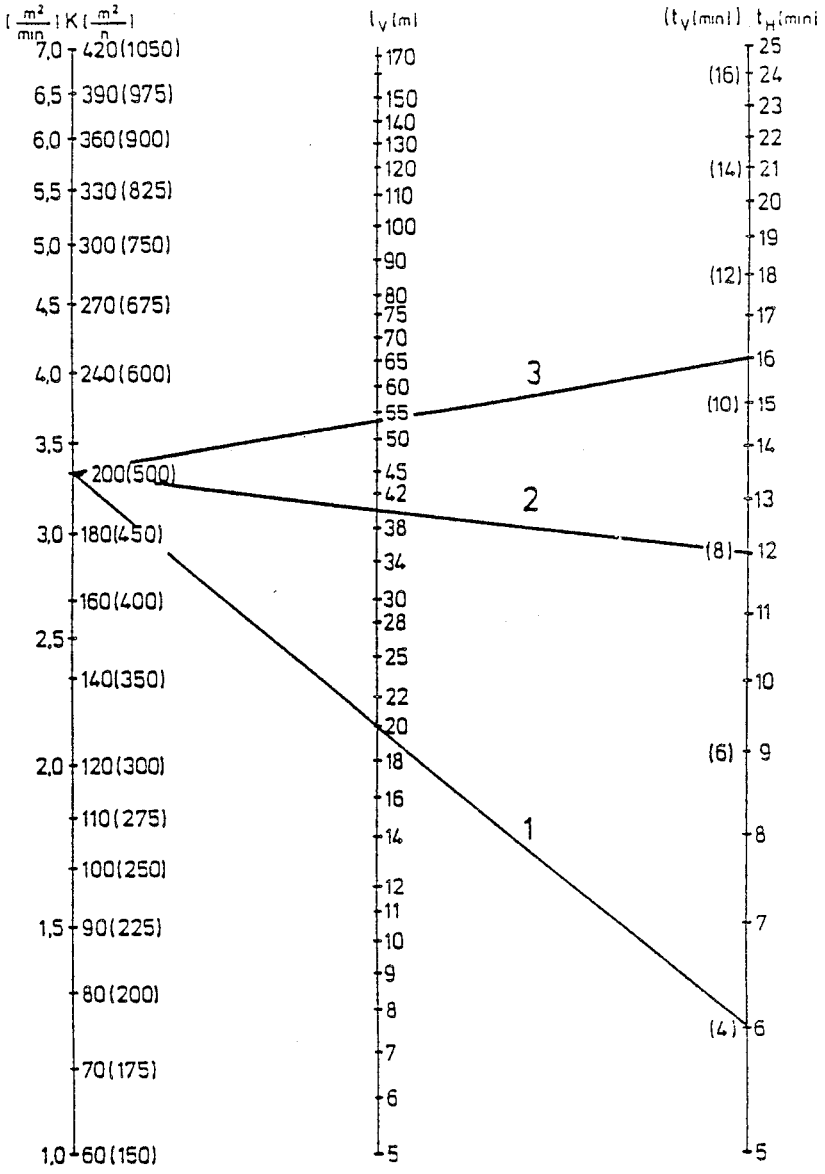

METHOD FOR CONTINUOUS MANUFACTURE OF INORGANICALLY BONDED MATERIALS, ESPECIALLY MATERIAL SLABS

This application is a continuation of application Ser. No. 763,444 filed Aug. 7, 1985, now abandoned.

The invention relates to a method for continuously manufacturing inorganically bonded materials, especially material slabs, from mixtures of binders, reinforcing agents, and possibly additives, the mixtures being cured by hydrate formation, and having a pourable or spreadable consistency. The special material properties and usability of the materials are achieved by a permanent and irreversible compression of the initially-formed structure, whereby an extruded slab is formed from the mixture and is then compressed and calibrated. In addition, the invention relates to a device for working this method.

The invention provides a technically simplified principle for continuous manufacture of inorganically bonded materials, e.g., slabs, from mixtures of binders, reinforcing agents, and possibly active and inactive additives, the mixtures being cured by hydrate formation. A permanent and irreversible structural compression is applied to the mixtures, usually by a pressure that acts during the total curing process.

It is known that materials can be manufactured from mixtures of bindable and reinforcing substances. Binders, reinforcing agents and possibly other active and inactive materials are mixed in a device suitable for the purpose according to predetermined ratios, poured or spread on a nonwoven fabric, and compressed in a press. The pressure required is a function of the properties of the raw materials which affect the deformation modulus of the mixture, the ratio of the slab fabric densities before and after the compression process, and of the deformation modulus of the fabric and the compression rate, which vary as a function of time.

Slabs with organic binders, in which the polycondensation or polyaddition that causes the curing is usually brought about by application of heat, are produced in heatable multi-stage presses or continuous presses such as, for example, those known from German AS No. 1,007,497 and German AS No. 1,938,280. The fact that mixtures with a high content of reinforcing agents and a low concentration of binder are used, results in the deformation moduli and the required compression pressures being relatively high, which presumes the development and use of compression systems of a heavy and costly design. However, the action of pressure and heat can usually be adjusted relative to one another so that curing takes place in the press during a relatively short residence time. The required length of the known continuous compression systems can therefore be kept within economically justifiable limits. The state of the art that has been achieved in this area is represented by the Hydro-Dyn Press made by the Bison Company and the continuous press built by Contipress, in the Federal Republic of Germany.

Mixtures with inorganic binders, such as cement and plaster, are considerably richer in binder and contain less reinforcing agents. They cure as a result of hydrate formation, i.e., the phases of the binder that are poorer in water react with water in compounds that are richer in water. This process is termed hydration; it proceeds exothermally and depends upon the reactivity of the binder with respect to water. If chemically non-neutral reinforcing agents are added to this binder-water binary system, e.g., wood, the reactions that occur between the various phases of the binder and the water are often readily disturbed. Most wood ingredients act as hydration and crystallization inhibitors, i.e., they delay the curing process. On the other hand, wood ingredients produce accelerating effects only very rarely. In order to counteract these undesirable effects of the wood, additives which accelerate or delay hydration (adjusters) are employed. Because of their unfavorable side effects (deterioration of the physical properties of the slabs, blooming phenomena), they are usually not applicable to the degree which would be desirable from the technical standpoint. For this reason, less problematical hydrothermal accelerating effects are employed more frequently when manufacturing cement-bonded slabs. The curing processes of plaster-bonded slabs cannot be activated in this fashion.

Despite these various ways of deliberately influencing the reactions in such material systems, a technological optimum cannot be reached in most cases. This means that the manufacturing facilities must handle certain fluctuations in this respect. In the case of discontinuous manufacture, this is accomplished by extending the residence time in the press, which cuts down on capacity, or by storing the slabs between stages in expensive clamping frames which transfer the pressure imposed by the compression process, at least until the end of hydration, to the stacked packets. As hydration time and capacity requirements increase, the required number of clamping frames increases and raises the investment outlay at the same time. The economics and efficiency of such installation are thus rendered correspondingly low.

Continuous manufacturing facilities must have considerable lengths in order to make the structural compression irreversible and to compensate for major fluctuations in hydration time as a function of capacity. So far, no solutions ready for use in industrial facilities have been found.

The relationship between the length of the compression and calibration device $l_V$, the capacity K, and the hydration time $t_H$ is expressed by the formula $$l_V = K/b_p \cdot t_H$$

If we assume that the width of the extruded slab $b_p$ is constant (advantageously 1 meter), this relationship can be linearized and plotted as a nomogram as shown in FIG. 1. It indicates that progressive capacity expectations call for a greater length of the compression and calibration device as well as a corresponding increase in investment outlay. To reduce plant costs, multi-range presses are preferred in known facilities for manufacturing materials on an organic binder basis, i.e., the pressure is varied in the individual zones of the press to correspond to the time-dependent deformation modulus of the extruded slab. In addition, it is known from German Pat. No. 2,126,935 that improved surface quality and higher strength can be achieved when manufacturing chipboard bonded with synthetic resin in heatable systems, if the chipboard fabric is compressed at the beginning of the compression process to a thickness which is less than the desired final thickness, and then is finally pressed at the desired final thickness.

In addition, the following citations are given as the state of the art: Kossatz, G. and K. Lempfer: "Manufacturing Gypsum-Bonded Chipboards in a Semi-Dry Process." Holz Als Roh- und Werkstoff, Volume 40, pages 333–337, 1982; "Technical Information: The Continuous Hydro-Dyn Press, Another Step Forward." Holz-Zentralblatt, No. 56/57, Stuttgart, May 11, 1983; Kossatz, G., Lempfer, K. and H. Sattler: "Inorganically Bonded Derived Timber Product Slabs." FESYP-Geschaeftsbericht, pages 98–198, 1982–83; Buecking, G.: "Manufacturing Gypsum-Bonded Chipboard in an Endless Process." Holz als Roh- und Werkstoff, Volume 41, pages 427–430, 1983; Ahrweiler, K.: "Controlling the Thickness and Density of Chipboard in a Continuous Press." Report on the 6th Colloquium on Wood Technology, 1980 in Braunschweig; and Huebner, J. E.: "The Semi-dry Process for Manufacturing Gypsum-Bonded Chipboard." Report on the 7th Colloquium on Wood Technology, 1983 in Braunschweig.

The specific physical effect of stress relaxation and the possibility of using it to manufacture considerably simplified and more cost-effective manufacturing facilities has not been recognized heretofore, which may be due to the fact that essentially dry mixtures of materials with much higher deformation moduli are used to manufacture chipboards that are bonded with synthetic resin. All known compression machinery accordingly suffers from the disadvantage that the equipment required for compressing the slab fabric must create and transmit relatively high pressures throughout the entire curing time, and necessitates an accordingly complicated and heavy design. To eliminate such high-cost solutions, for example in manufacturing cement-bonded chipboards, discontinuous and consequently less effective manufacturing techniques are employed (Bison cement-slab system).

The goal of the invention is to develop a continuous process and a continuous device for manufacturing materials based on inorganic binders, which are more economical, less capital-intensive and more productive, and which also overcome the other disadvantages outlined above.

This goal is achieved according to the invention by a method of the type recited at the outset, in which the extruded slab is compressed prior to calibration in a compression phase at a pressure which is sufficiently high that the slab's thickness after compression is less than the specified thickness of the finished extruded slab, and its density exceeds the specified density of the finished slab, and both (thickness and density) are sufficiently great that the compressed extruded slab can be calibrated to its specified final thickness and density immediately thereafter without active pressure application, in a calibration phase.

A device for working this method is characterized according to the invention by the fact that (a) The compression device which is located upstream of the calibrating device in the direction of travel of the extruded slab compresses the extruded slab with a higher pressure than that required for achieving the specified thickness and density of the finished extruded slab, so that the extruded slab is compressed to a thickness less than its specified thickness, in such fashion that no subsequent active pressure effect is required and (b) The calibrating device, located immediately downstream from the compressing device, is a calibrating device that operates without any active pressure effects on the extruded slab, in which, as a result of the considerably reinforced stress relaxation that occurs in the extruded slab as a result of the thorough moistening of the mixture, the restoring forces are reduced to the point where active calibration pressures are superfluous.

In this manner, in particular, a situation is created in which the installation of costly, preferably hydraulic, pressure generating and transmitting devices like those required for working the compression phase or in the compressing device, is limited to a relatively small area, because the compression zone becomes relatively short, while the longest part (usually 10 to 25 times the compression zone) is designed as a technically simple calibrating device without active pressure application. In the invention, the only purpose of the calibrating device is to receive the restoring forces, reduced in the manner described, from the extruded slab which is compressed in the press of the compressing device or in the compression phase, and to keep it at the specified thickness until hydration is complete. Such a continuous calibrating device can be created in a relatively simply fashion, for example by disposing calibrating rollers in sequence. The conversion from pressure along a line between the calibrating rollers and the extruded slab into pressure over an area is made possible by a suitable stiffening of the shaping belt or by introducing suitable carrier sheets. The gap in the compression and calibrating device can be made suitably adjustable to adjust the device according to the invention to various extruded slab thicknesses. This procedure and this design according to the invention are based on the fact that the relaxation process which is required for the compression process and to reduce the restoring forces takes place before or at the latest during the initial phase of hydration. Interference with the structure and strength formation process is thereby eliminated.

Embodiments of the invention are described in the subclaims.

Figure 2:
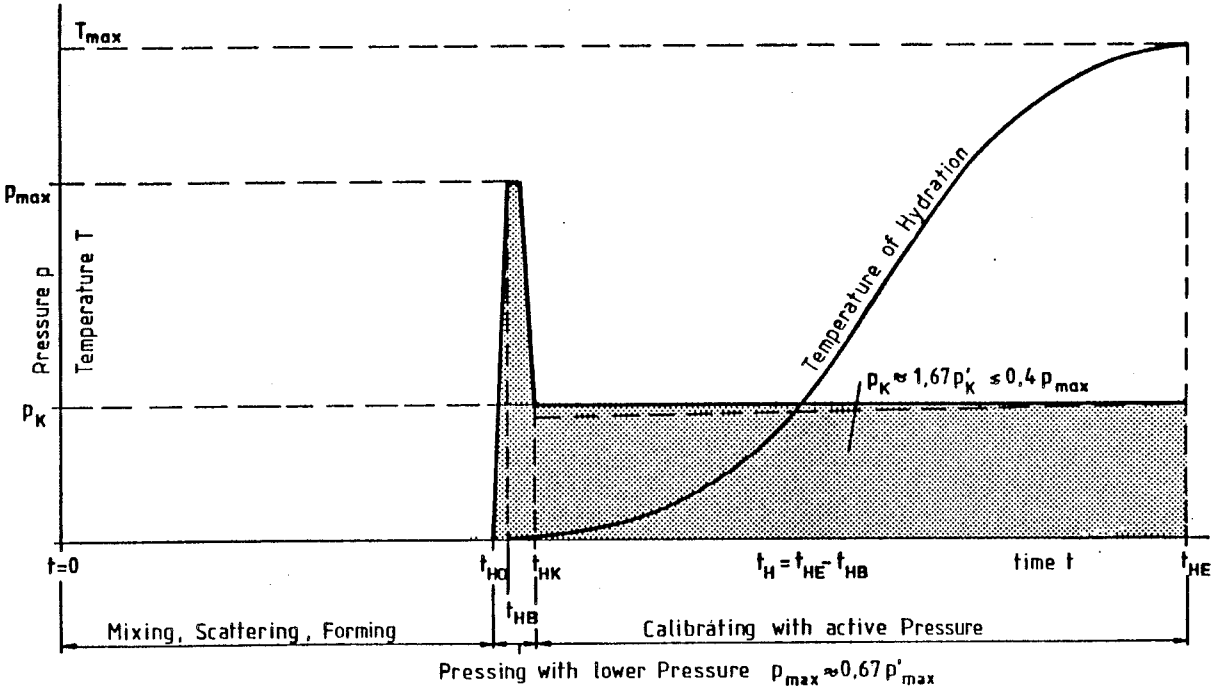

The invention will now be described with reference to the embodiments shown in FIGS. 1 and 2 in the drawings:

FIG. 1 is a nomogram to determine the total length of the compression and calibration zone $l_V$ as a function of the hydration time of plaster, $t_H$, and the capacity of the system, K, with a one-meter extruded slab width, wherein the values in parentheses on the K scale correspond to the capacity for a 2.5-meter extruded slab width and the values in parentheses on the t scale represent the approximate anticipated processing time of the plaster, $t_V$;

FIG. 2 is a drawing of the prior art process, showing the functional arrangement of the compression process during the compression of an extruded slab for manufacturing plaster chipboards for the hyrdration or curing process of the mixture, whereby, in contrast to the invention, compression is carried out at low pressure corresponding to the specified thickness of the extruded slab to be achieved, followed by calibration with active application of pressure.

Figure 3:
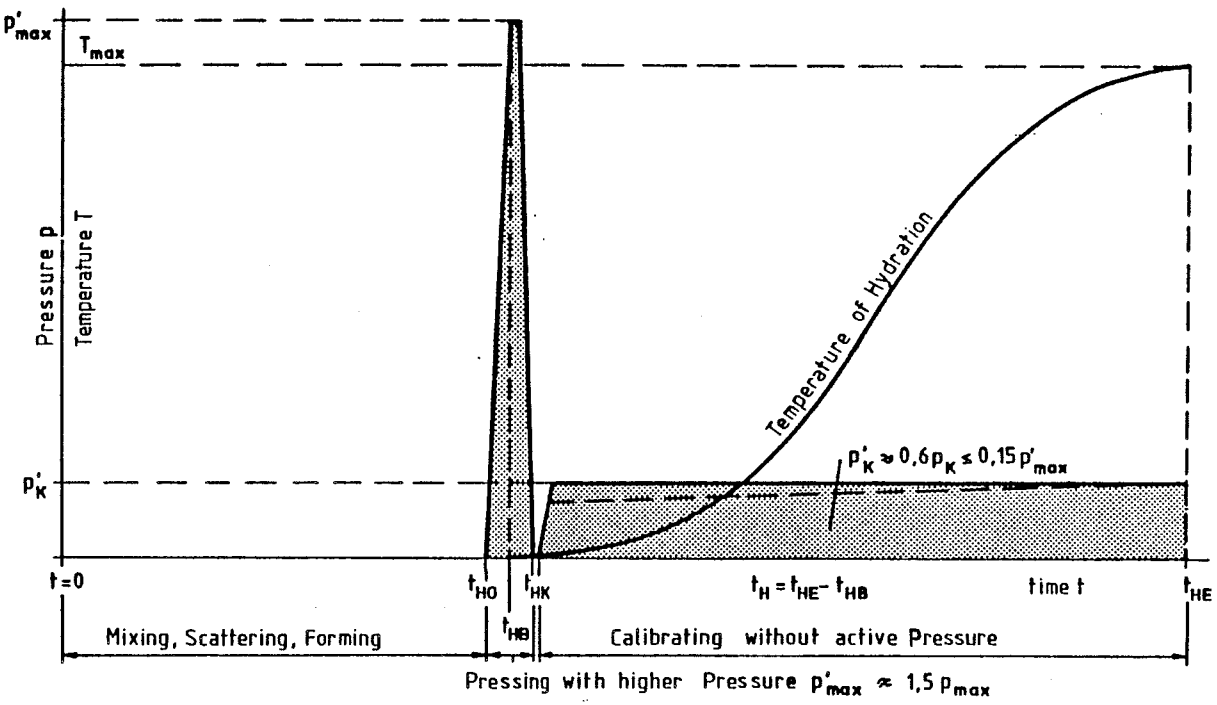

In FIGS. 2–3, $t_{HO}$ indicates the time at which compression starts; $t_H$ indicates overall hydration time; and $t_{HE}$ indicates the time at which hydration ends.

FIG. 3 is a drawing of the process of the invention, showing the appearance of the pressure curve by function during the compression of an extruded slab for manufacturing plaster chipboard for the hydration or curing process of the mixture, whereby according to the invention compression is carried out at a higher pressure that produces a thickness lower than the specified thickness of the extruded slab, and calibration is subsequently performed without active application of pressure.

To work a method for continuous manufacture of materials made of mixtures of binders, reinforcing agents, and possibly additives, cured by hydrate formation, with a pourable or spreadable consistency, with permanent and irreversible compression of the structure in such fashion that an extruded slab is formed from the mixture and is then compressed and calibrated, whereby the extruded slab is compressed prior to calibration in a compression phase at a pressure which is sufficiently high that its thickness is less than the specified thickness of the finished extruded slab after compression, but exceeds the density of the latter, both values being sufficiently great that the compressed extruded slab is calibratable in a calibration phase immediately afterward without active pressure application, the specific deformation or compressibility behavior of the mixture used to manufacture the material is utilized. A comparison between FIGS. 2 and 3 explains how this is accomplished:

The maximum pressure $p_{max}$ in the pressure curve in FIG. 2 for producing the specified thickness and specified bulk density of the material is required only for a relatively short time at the beginning of the compression phase. Thereafter, pressure p builds up quickly by lowering the deformation modulus to a value of $p_k \simeq 0.4\ p_{max}$. If, on the other hand, as shown in FIG. 3, according to the solution of the invention, the maximum pressure is increased to $p'_{max} \simeq 1.5\ p_{max}$, the thickness of the slabs is a small amount (about 10%) less than the specified thickness and, as a result of relaxation, $p'_k$ becomes about 40% less than $p_k$; in other words, the higher pressure $p'_{max}$ used in a very short compression phase leads in an extraordinarily favorable fashion to a considerable reduction of the required calibration pressure $p'_k$ during the very long calibration phase, namely at a calibration pressure which is so low that calibration can be performed without the active application of pressure.

The specific compressibility behavior of the mixtures used can therefore be used to produce a technically much simpler and more cost-effective continuous manufacturing system which consists of two corresponding zones to compress and calibrate the extruded slab:

(a) Compression zone, pressure increased from $p=0$ to $p=p'_{max} \simeq 1.5\ p_{max}$.

Length $l_V$ preferably a maximum of 5 m (independent of system capacity)

(b) Calibration zone without active influence of pressure (only to receive the relatively low inherent restoring pressure of $p'_k \leqq 0.15\ p'_{max} \simeq 0.60\ p_k \leqq 0.22\ p_{max}$).

Necessary length: $l_K = K/b_p \cdot t_H$

The installation of costly, preferably hydraulic-pressure-generating and pressure-transmitting equipment is therefore limited to the relatively small area of the compression zone, while the relatively very long calibrating device requires no active application of pressure, and can therefore be built with relatively low system costs.

The advantage of the solution according to the invention will now be described in greater detail with the following example:

Mixtures are used to manufacture plaster-bonded wood-chip-reinforced structural slabs whose hydration time $t_H$ is a minimum of 6 minutes (see line 1 in FIG. 1) and a maximum of 12 minutes (FIG. 1, line 2) ($6 \leqq t_H \leqq 12$). The extruded slab width should be 2.5 meters and the manufacturing capacity K should be 500 $m^2$ per hour.

For a mixture with a short hydration time, we can expect that stiffening will begin after 4 minutes and that hydration will terminate accordingly after 10 minutes; for the mixture with the longer hydration time we can expect stiffening to begin after 8 minutes and hydration to end after 20. The hydration time which is used as a basis for determining the required length of the compression system as a figure for computation is obtained from the difference between the latest hydration end (20 minutes) and the shortest time for stiffening to begin (4 minutes): 16 minutes.

This means that the compression system, in order to compensate for such fluctuations in hydration time, must be at least 53 m long (FIG. 1, line 3), if compressing takes place as shown in FIG. 2 at a pressure at which the specified thickness and density of the extruded slab are never undershot or overshot. Since a relatively high pressure must be applied to the extruded slab without taking the solution according to the invention into account, during the above-described long travel of the extruded slab, this compression device is very costly in terms of material and money. When the solution according to the invention is employed, on the other hand, the following lengths have been obtained for example for the various compression and calibration zones that have to be designed differently:

(a) Compression zone: 2.5 m (b) Calibration zone: 53 m long

The example shows that in the invention the part of the compression system which is by far the longest can be designed as a calibration device without the active influence of pressure, whereby the system manufacturing costs can be considerably reduced by comparison to other comparable systems. It is advantageous in this connection that only one structural dimension which depends on the design requirements is needed for the press (compression zone) for a uniform extruded slab width. To meet various capacity requirements it is sufficient to design and offer the calibrating device connected downstream from the press or the compression device with variable length. A segmented design is especially advantageous in this respect, making it possible to assemble systems with a high capacity from smaller-capacity modules. Especially favorable conditions are thereby created also for subsequent retrofitting to handle larger capacities.

In short, the invention relates to a technically simplified process which can be implemented at low cost as well as a technically simplified and inexpensive device for continuously manufacturing materials, especially slabs, from mixtures of binders, reinforcing agents, and possibly additives, cured by hydrate formation, with a pourable or spreadable consistency, which obtain their essential material properties as a result of the action of pressure which usually begins before the curing reactions and lasts until hydration is complete. In order to satisfy ordinary capacity requirements, continuous manufacturing systems must be of considerable length, which has a negative effect on system costs especially when it comes to long-term application of high pressures. According to the invention, the specific deformation or compressibility behavior of the mixtures employed is utilized to produce a reduction of the restoring forces caused by the compressed slab fabric, by a higher initial compression than is required to produce the specified thickness and density, such that the timeconsuming curing processes occur during a calibration without the active application of pressure and thereby considerably reduce the costs of the system.

I claim:

1. A method for continuous manufacture of slabs of material based on inorganic binders which cure by hydration, comprising the following steps:

forming an aqueous mixture including at least one inorganic binder which cures by hydrate formation and at least one reinforcing agent, said binder being selected from the group consisting of plaster and cement; said mixture having a pourable and spreadable consistency;

extruding said mixture continuously in the form of a slab;

compressing said extruded slab in a compression device, before hydration of said inorganic binder begins to occur, by application of pressure which is sufficiently high that the thickness of said slab after compression is less than the thickness specified for the finished extruded slab, and the density of said slab after compression exceeds the density specified for the finished extruded slab, the degree of compression being sufficiently large that after removal of the compressing pressure, restoring forces in the compressed extruded slab are sufficient to increase the thickness of the slab to such a value, greater than the final thickness specified for the slab, that the slab is calibratable to its specified final thickness and density in a calibration device which is capable of passively resisting residual restoring forces in the slab without active application of pressure;

removing the compressing pressure after hydration of said inorganic binder has begun and before hydration is complete; and calibrating said extruded slab to a specified final thickness and density after removing the compressing pressure, by keeping said slab at the thickness specified for the finished slab until hydration is complete, in a calibration device which passively resists residual restoring forces in the slab without active application of pressure.

2. The method according to claim 1 wherein the pressure employed in said compressing step is maintained for a period of time which is independent of the hydration time of the binder and is shorter than the time required for said calibrating step.

3. The method of claim 1, wherein the compressing step is carried out by employing a compression device whose length is much less than that of the calibrating device, so that the pressure required for compression is applied only during a short time.

4. The method of claim 1 wherein said compressing step is carried out by employing a press having an adjustable throughput rate and gap, the length of said press being independent of the capacity of the device and determined only by the design requirements of the compressing device.

5. The method of claim 4, wherein the length of the press is a maximum of 5 meters.

6. The method of claim 1 wherein the calibrating step is carried out employing a calibration device having a minimum length $l_k$ which is determined from the hydration time $t_H$, the capacity K of the device, and the width of the extruded slab $b_p$ according to the following equation:

$$l_K = K/b_p \cdot t_H$$

said calibration device further being adjustable in terms of its throughput rate and calibration gap, to compensate for fluctuations in the hydration time of the binder.

7. The method of claim 1 wherein the calibrating step is carried out employing a calibration device composed of a plurality of individual identical modules, said calibration device therefore being adjustable to various lengths and capacities.

8. The method of claim 1 wherein the time between the application of the pressure in the compressing step and the removal of that pressure in the removing step is from 1/10 to 1/25 of the time required for said calibrating step.

9. The method of claim 1 wherein the reinforcing agent is wood chips.

10. The method of claim 1 wherein said aqueous mixture further comprises at least one additive capable of influencing the rate of hydration of binder material in the presence of reinforcing material.

* * * * *

UNITED STATES PATENT AND TRADEMARK OFFICE

CERTIFICATE OF CORRECTION

PATENT NO. : 4,784,816

DATED : November 15, 1988

INVENTOR(S) : Heinz Sattler

It is certified that error appears in the above-identified patent and that said Letters Patent is hereby corrected as shown below:

Abstract, line 14, "density specified" should read --density exceeds the--.

Column 4, line 19, "simply" should read --simple--.

Column 4, line 52, "hyrdration" should read --hydration--.

Column 4, lines 58-59, "$t_{HO}$ indicates the time at which compression starts;" should read --$t_{HB}$ indicates the time at which hydration starts;--.

Signed and Sealed this

Thirteenth Day of February, 1990

*Attest:*

JEFFREY M. SAMUELS

*Attesting Officer* *Acting Commissioner of Patents and Trademarks*